US005640648A

United States Patent [19]

Komakine et al.

[11] Patent Number: 5,640,648

[45] Date of Patent: Jun. 17, 1997

[54] ELECTROPHOTOGRAPHIC APPARATUS HAVING SEALING MEMBER

[75] Inventors: Hiroshi Komakine, Moriguchi; Kazumasa Hayashi, Osaka; Katsutoshi Ogawa, Hirakata; Kenji Asakura, Katano; Toshiharu Koshino, Kadoma, all of Japan

[73] Assignee: Matsushita Electric Industrial Co., Ltd., Osaka, Japan

[21] Appl. No.: 490,332

[22] Filed: Jun. 14, 1995

[30] Foreign Application Priority Data

Jun. 15, 1994 [JP] Japan ..... 6-132968

[51] Int. Cl.[6] ..... G03G 15/00

[52] U.S. Cl. ..... 399/103; 399/105; 399/267

[58] Field of Search ..... 355/215, 245, 355/251, 260; 118/647, 653, 657; 399/103, 104, 105, 267, 277

[56] References Cited

U.S. PATENT DOCUMENTS 4,697,914 10/1987 Hauser ..... 355/215

4,742,797 5/1988 Barker ..... 355/215 X 5,298,949 3/1994 Yamamoto et al. ..... 118/657 X

*Primary Examiner*—Joan H. Pendegrass

*Attorney, Agent, or Firm*—Ratner & Prestia

[57] ABSTRACT

Disclosed is an electrophotographic apparatus capable of producing a high-quality image free from image defects such as fine line dropouts. A photoconductor drum is used that has a magnet mounted therein in immovable fashion. After an electrostatic latent image is formed, the image is brought into contact with magnetic developer in a developer reservoir, causing the developer to be attracted to the photoconductor surface by magnetic force. When the photoconductor drum is rotated past an electrode roller to which an AC voltage is applied, toner is left only in image areas and the latent image is developed into a visible image. A sheet-like sealing member contacting the photoconductor is disposed on the upstream side of the developer reservoir in the rotating direction of the photoconductor drum. A conductive layer is provided on the surface of the sealing member opposite the surface thereof contacting the photoconductor.

14 Claims, 6 Drawing Sheets

ELECTROPHOTOGRAPHIC APPARATUS HAVING SEALING MEMBER

BACKGROUND OF THE INVENTION

1. Field of the Invention

The present invention relates to an electrophotographic apparatus that can be adapted for a printer, a facsimile machine, or the like.

2. Description of the Related Art

Traditionally, two-component developing methods that use developer consisting of toner and carrier have been widely used in electrophotography, but in recent years, the development of one-component developing methods has been proceeding aiming at reducing the size and cost of image-forming sections. FIG. 11 shows an example of an electrophotographic apparatus employing such a one-component developing method. In FIG. 11, reference numeral 1 designates an organic photoconductor drum, an electrostatic latent image holding member, coated with a layer of phthalocyanine dispersed in a polyester-based binding resin, and reference numeral 2 indicates a two-pole magnet fixed coaxially with the photoconductor 1. Reference numeral 3 is a corona charging unit for applying a charge on the photoconductor 1; 4 is a grid electrode for controlling the charge potential of the photoconductor 1; 5 is a signal light; 6 is a developer reservoir,; 7 is a one-component magnetic toner which is the developer; 8 is an aluminum electrode roller; and 9 is a two-pole magnet fixed coaxially with the electrode roller 8. Further, reference numeral 10 is an AC high-voltage unit for applying a voltage to the electrode roller 8; 11 is a scraper, made of a polyester film, for scraping toner from the electrode roller 8; 12 is a corona transfer unit for separating the toner image from the photoconductor 1 and transferring it onto paper; and 13 is a 38 μm thick sealing member formed from a polyethylene terephthalate film which is disposed, in contacting relationship with the photoconductor 1, on the upstream side of the developer reservoir 6 in the rotating direction of the photoconductor 1.

The operation of the above electrophotographic apparatus will be described below with reference to FIG. 11. The photoconductor 1 is charged to −500 V by means of the corona charging unit 3 and the grid electrode 4. The photoconductor 1 is then exposed to the laser beam 5 to form an electrostatic latent image thereon. Toner 7 is attracted by magnetic force to the surface of the photoconductor 1 as the surface passes the developer reservoir 6. The revolving photoconductor 1 then passes the electrode roller 8. At this time, an AC voltage of 800 V 0-p (zero to peak) (frequency 3 kHz) with a DC voltage of −300 V superimposed thereon is applied to the electrode roller 8 by means of the AC high-voltage unit 10. This causes toner on the photoconductor 1 to be attracted toward the electrode roller 8, leaving only a reversed toner image in the image areas of the photoconductor 1. The toner adhering to the electrode roller 8 revolving in the direction shown by the arrow is scraped by the scraper 11, and returned to the developer reservoir 6 for use for the next image forming process. The toner image thus formed on the photoconductor 1 is transferred onto paper (not shown) by means of the corona transfer unit 12, and then fused to the paper by a fusing unit (not shown).

The one-component developing method employed in such an electrophotographic apparatus is an excellent developing method that can provide high image quality of very high resolution by supplying a sufficient amount of toner to the surface of a latent image. However, since a sufficient amount of developer must be held at all times between the photoconductor and the electrode roller, a seal for preventing developer leakage becomes an important consideration. In the prior art electrophotographic apparatus shown in FIG. 11, to prevent developer leakage a 38 μm thick sheet-like sealing member 13 formed from a polyethylene terephthalate film and contacting the photoconductor was provided on the upstream side of the developer reservoir in the rotating direction of the photoconductor. However, when printing was performed using such an electrophotographic apparatus, there occurred a problem of partial image dropouts in the case of a fine-line image.

To overcome the shortcomings of prior art sealing members for an electrophotographic apparatus, various sealing member arrangements have been provided.

SUMMARY OF THE INVENTION

In an electrophotographic apparatus in which magnetic toner adhering to the entire surface of a photoconductor is collected by a bare electrode roller, the present invention provides an electrophotographic apparatus that can produce a high-quality image free from defects such as image dropouts in a fine-line image.

The present invention provides an electrophotographic apparatus which comprises: a magnetic developer; an electrostatic latent image holding member rotating in a designated direction; an electrode roller disposed opposite a surface of the electrostatic latent image holding member with a prescribed gap provided therebetween, and rotating in such a direction as to counter the rotation of the electrostatic latent image holding member; a developer reservoir for supplying the magnetic developer to the surface of the electrostatic latent image holding member; means for applying an AC voltage to the electrode roller to remove developer from nonimage areas of the electrostatic latent image holding member; magnetic field generating means, mounted in a fixed position inside the electrostatic latent image holding member, for generating a magnetic pole at a surface position of the electrostatic latent image holding member near a developing area where the electrostatic latent image holding member faces the electrode roller; and a sheet-like sealing member disposed, in contacting relationship with the electrostatic latent image holding member, on the upstream side of the developer reservoir in the rotating direction of the electrostatic latent image holding member, the sealing member having a conductive layer formed on a back surface thereof.

The invention also provides an electrophotographic apparatus which comprises: a magnetic developer; an electrostatic latent image holding member rotating in a designated direction; an electrode roller disposed opposite a surface of the electrostatic latent image holding member with a prescribed gap provided therebetween, and rotating in such a direction as to counter the rotation of the electrostatic latent image holding member; a developer reservoir for supplying the magnetic developer to the surface of the electrostatic latent image holding member; means for applying an AC voltage to the electrode roller to remove developer from nonimage areas of the electrostatic latent image holding member; magnetic field generating means, mounted in a fixed position inside the electrostatic latent image holding member, for generating a magnetic pole at a surface position of the electrostatic latent image holding member near a developing area where the electrostatic latent image holding member faces the electrode roller; a sheet-like sealing member disposed, in contacting relationship with the electrostatic latent image holding member, on the upstream side of the developer reservoir in the rotating direction of the electrostatic latent image holding member; and a second sealing member, interposed between the sealing member and the developer reservoir, for preventing the developer supplied from the developer reservoir from being carried to the back surface of the sheet-like sealing member.

The invention also provides an electrophotographic apparatus which comprises: a magnetic developer; an electrostatic latent image holding member rotating in a designated direction; an electrode roller disposed opposite a surface of the electrostatic latent image holding member with a prescribed gap provided therebetween, and rotating in such a direction as to counter the rotation of the electrostatic latent image holding member; a developer reservoir for supplying the magnetic developer to the surface of the electrostatic latent image holding member; means for applying an AC voltage to the electrode roller to remove developer from nonimage areas of the electrostatic latent image holding member; magnetic field generating means, mounted in a fixed position inside the electrostatic latent image holding member, for generating a magnetic pole at a surface position of the electrostatic latent image holding member near a developing area where the electrostatic latent image holding member faces the electrode roller; and a sheet-like, loop-shaped sealing member disposed, in contacting relationship with the electrostatic latent image holding member, on the upstream side of the developer reservoir in the rotating direction of the electrostatic latent image holding member.

The invention also provides an electrophotographic apparatus which comprises: a magnetic developer; an electrostatic latent image holding member rotating in a designated direction; an electrode roller disposed opposite a surface of the electrostatic latent image holding member with a prescribed gap provided therebetween, and rotating in such a direction as to counter the rotation of the electrostatic latent image holding member; a developer reservoir for supplying the magnetic developer to the surface of the electrostatic latent image holding member; means for applying an AC voltage to the electrode roller to remove developer from nonimage areas of the electrostatic latent image holding member; magnetic field generating means, mounted in a fixed position inside the electrostatic latent image holding member, for generating a magnetic pole at a surface position of the electrostatic latent image holding member near a developing area where the electrostatic latent image holding member faces the electrode roller; a sheet-like sealing member disposed, in contacting relationship with the electrostatic latent image holding member, on the upstream side of the developer reservoir in the rotating direction of the electrostatic latent image holding member; and a spacer, bonded to the back surface of the sealing member, for filling a space on the side thereof opposite from where the sealing member contacts the electrostatic latent image holding member.

The invention also provides an electrophotographic apparatus which comprises: a magnetic developer; an electrostatic latent image holding member rotating in a designated direction; an electrode roller disposed opposite a surface of the electrostatic latent image holding member with a prescribed gap provided therebetween, and rotating in such a direction as to counter the rotation of the electrostatic latent image holding member; a developer reservoir for supplying the magnetic developer to the surface of the electrostatic latent image holding member; means for applying an AC voltage to the electrode roller to remove developer from nonimage areas of the electrostatic latent image holding member; magnetic field generating means, mounted in a fixed position inside the electrostatic latent image holding member, for generating a magnetic pole at a surface position of the electrostatic latent image holding member near a developing area where the electrostatic latent image holding member faces the electrode roller; and a sheet-like sealing member disposed, in contacting relationship with the electrostatic latent image holding member, on the upstream side of the developer reservoir in the rotating direction of the electrostatic latent image holding member, the sealing member having a surface resistance of $10^{12}$ Ω/□ or less.

The invention also provides an electrophotographic apparatus which comprises: a magnetic developer; an electrostatic latent image holding member rotating in a designated direction; an electrode roller disposed opposite a surface of the electrostatic latent image holding member with a prescribed gap provided therebetween, and rotating in such a direction as to counter the rotation of the electrostatic latent image holding member; a developer reservoir for supplying the magnetic developer to the surface of the electrostatic latent image holding member; means for applying an AC voltage to the electrode roller to remove developer from nonimage areas of the electrostatic latent image holding member; magnetic field generating means, mounted in a fixed position inside the electrostatic latent image holding member, for generating a magnetic pole at a surface position of the electrostatic latent image holding member near a developing area where the electrostatic latent image holding member faces the electrode roller; and a sheet-like sealing member disposed, in contacting relationship with the electrostatic latent image holding member, on the upstream side of the developer reservoir in the rotating direction of the electrostatic latent image holding member, an end of the sealing member being positioned so that the end is subjected to the influence of a magnetic field generated by the magnetic field generating means mounted in the electrostatic latent image holding member.

The present invention is concerned with an improved construction of an electrophotographic apparatus that uses an electrostatic latent image holding member containing a fixed magnet therein, and in which developer is applied to the electrostatic latent image holding member with an electrostatic latent image formed thereon and the developer is magnetically attracted to it, the thus attracted developer then being carried to an electrode roller where an AC bias is applied to remove toner from nonimage areas of the image holding member by electrostatic force and magnetic force.

According to the invention, the conductive layer provided on the back surface of the sealing member acts to even out and weaken the local charging or discharging that occurs when toner is attracted to or separated from the back surface of the sealing member, as a result of which the front surface of the sealing member is not easily affected by these phenomena. This stabilizes the electrostatic condition between the electrostatic latent image holding member and the sealing member, preventing the discharging from the sealing member to the electrostatic latent image holding member and eliminating the possibility of image dropouts in a fine-line image.

In a preferred mode of the invention, there is provided between the sealing member and the developer reservoir a second sealing member that acts to prevent the developer supplied from the developer reservoir from being carried to the back surface of the sealing member. Since no toner is distributed to the back surface of the sealing member, local charging or discharging due to the attraction or separation of toner does not occur. This stabilizes the electrostatic condition between the electrostatic latent image holding member and the sealing member, preventing the discharging from the sealing member to the electrostatic latent image holding member and eliminating the possibility of image dropouts in a fine-line image.

In a preferred mode of the invention, the sealing member is formed in the shape of a loop, creating a space on the back surface of the sealing member opposite the front surface thereof contacting the electrostatic latent image holding member, preventing toner from entering inside the loop. As a result, local charging or discharging due to the attraction or separation of toner does not occur. This stabilizes the electrostatic condition between the electrostatic latent image holding member and the sealing member, preventing the discharging from the sealing member to the electrostatic latent image holding member and eliminating the possibility of image dropouts in a fine-line image.

In a preferred mode of the invention, a spacer for filling a space on the back surface of the sealing member opposite the front surface thereof contacting the electrostatic latent image holding member is provided in intimate contact with the back surface of the sealing member, preventing toner from coming close to the back surface of the sealing member opposite the surface thereof contacting the electrostatic latent image holding member. As a result, local charging or discharging due to the attraction or separation of toner occurs at a position spatially distanced from the contacting point. This stabilizes the electrostatic condition between the electrostatic latent image holding member and the sealing member, preventing the discharging from the sealing member to the electrostatic latent image holding member and eliminating the possibility of image dropouts in a fine-line image.

In a preferred mode of the invention, the surface resistance of the sealing member is made $10^{12}$ Ω/□ or lower, so that the charges accumulated on the front surface of the sealing member through friction with the electrostatic latent image holding member become easier to move to stabler positions. This makes the discharging from the sealing member to the electrostatic latent image holding member difficult to occur, and fine-line images are less susceptible to image dropouts.

In a preferred mode of the invention, the end of the sealing member is positioned so that the end is subjected to the influence of the magnetic field generated by the magnetic field generating means mounted inside the electrostatic latent image holding member. As a result, the toner near the end of the back surface of the sealing member is held fixed to the sealing member, and the entire toner on the back surface remains stationary there, preventing toner attraction or separation on the sealing member, and hence no local charging or discharging. This stabilizes the electrostatic condition between the electrostatic latent image holding member and the sealing member, preventing the discharging from the sealing member to the electrostatic latent image holding member and eliminating the possibility of image dropouts in a fine-line image.

DESCRIPTION OF THE PREFERRED EMBODIMENTS

According to the present invention, there is shown an electrophotographic apparatus capable of producing a high quality image free from defects such as fine-line dropouts. It is discovered that these defects are caused by charges accumulated on the surface of the sealing member through friction created between the sealing member and the photoconductor which were discharged onto a latent image of a fine-line picture. Further, it is believed that the discharge was triggered by the electrostatic action of the toner against the surface of the sealing member opposite the surface thereof, contacting the photoconductor. The present invention solves these prior art problems by providing the electrophotographic apparatus which is described below with reference to the accompanying drawings.

(Embodiment 1)

Figure 1:
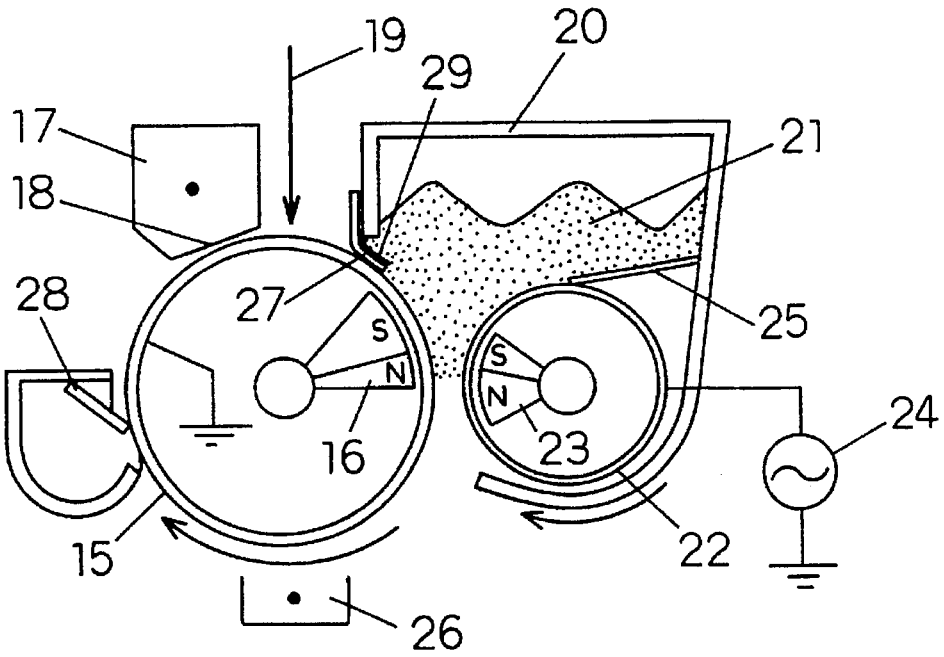
FIG. 1 is a diagram showing the construction of an electrophotographic apparatus according to a first embodiment of the present invention.
Figure 2:
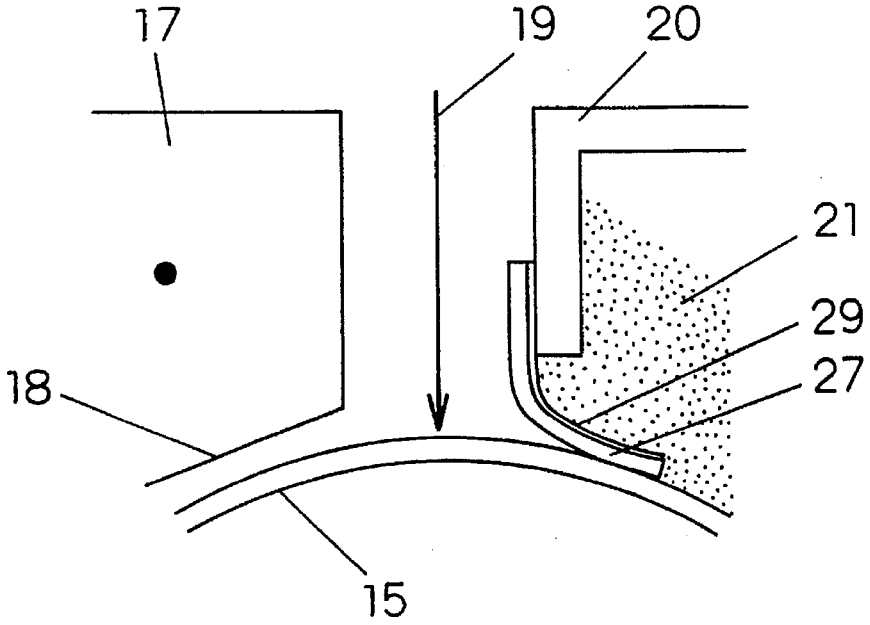
FIG. 2 is an enlarged view of a sealing member and its adjacent parts in the first embodiment of the present invention.

FIG. 1 is a diagram showing an electrophotographic apparatus according to a first embodiment of the present invention. In the figure, reference numeral 15 is an organic photoconductor drum (diameter 30 mm), an electrostatic latent image holding member, coated with a layer of phthalocyanine dispersed in a polyester-based binding resin, the drum being rotated at a surface speed of 30 mm/s; 16 is a two-pole magnet fixed coaxially with the photoconductor 15; 17 is a corona charging unit for negatively charging the photoconductor 15; 18 is a grid electrode for controlling the charge potential of the photoconductor 15; 19 is a signal light; 20 is a developer reservoir; and 21 is one-component toner with an average particle size of about 12 μm, the toner being negatively charged. Further, reference numeral 22 is an aluminum electrode roller (diameter 16 mm) which is rotated at a surface speed of 30 mm/s in the opposite direction to the rotating direction of the photoconductor 15; 23 is a two-pole magnet fixed coaxially with the electrode roller 22; 24 is an AC high-voltage unit for applying a voltage to the electrode roller 22; 25 is a scraper, formed from a polyester film, for scraping toner from the electrode roller 22; 26 is a corona transfer unit for transferring a toner image, formed on the photoconductor 15, onto paper; 27 is a 38 μm thick sealing member, formed from a polyethylene terephthalate film and having a free length of 5 mm, for sealing the gap between the developer reservoir and the photoconductor; 28 is a cleaning blade for cleaning the photoconductor 15 of residual toner after the toner image was transferred; and 29 is an aluminum layer evaporated on the surface of the sealing member 27 opposite the surface thereof contacting the photoconductor 15. FIG. 2 is an enlarged view of the sealing member 27 and its adjacent parts.

The one-component magnetic toner used in this embodiment consists of polyester resin 70%, ferrite 25%, carbon black 3%, and hydroxy carboxylic acid metallic complex 2%, with 0.5% colloidal silica added (by weight percent).

Figure 3:
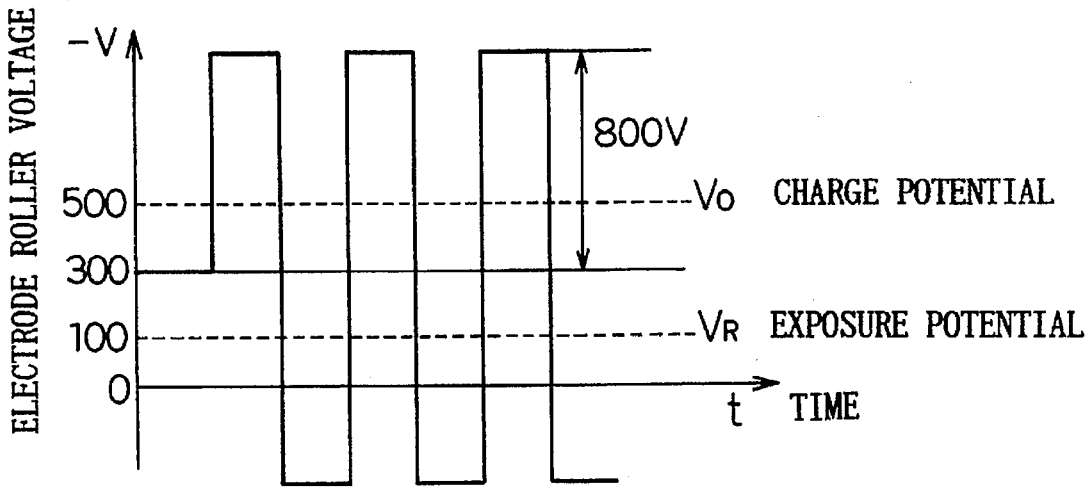
FIG. 3 is a simplified diagram showing the waveform of an AC voltage used in the first, second, third, fourth, fifth, sixth, seventh, and eighth embodiments of the present invention.

The operation of the thus constructed electrophotographic apparatus will be described below with reference to FIG. 1. The photoconductor 15 was charged to −500 V by means of the corona charging unit 17 (applied voltage −4 kV, grid electrode voltage −500 V). The photoconductor 15 was then exposed to the laser beam 19 to form an electrostatic latent image thereon. At this time, the exposure potential (Vr) of the photoconductor 15 was −100 V. One-component magnetic toner was attracted to the surface of the photoconductor 15 by the magnetic force of the magnet 16 contained therein as the surface passed the developer reservoir 20. At this time, the toner was charged to about −3 μC/g. Next, the toner attracted to the surface of the photoconductor 15 was transported to a position opposite the electrode roller 22 with the rotation of the photoconductor 15. The toner layer formed on the surface of the photoconductor 15 was thus made to pass the electrode roller 22 which was spaced away from the photoconductor 15 by 250 μm. An AC voltage of 800 V 0–p (frequency 3 kHz) with a DC voltage of −300 V superimposed thereon was applied to the electrode roller 22 by means of the AC high-voltage unit 24. The waveform of the applied voltage is shown in FIG. 3. As the toner layer formed on the photoconductor 15 moved between the photoconductor 15 and the electrode roller 22, the toner in the non-image areas was gradually transferred to the electrode roller 22, eventually leaving only a reversed toner image in the image areas of the photoconductor 15. The toner adhering to the electrode roller 22 was transported with the rotation thereof in the direction shown by the arrow, scraped by the scraper 25, and returned to the developer reservoir 20, thus preparing the electrode roller 22 for the next image-forming process. The toner image thus formed on the photoconductor 15 was transferred to paper (not shown) by means of the corona transfer unit 26, and then fused to the paper by a fusing unit (not shown). According to the above construction, the phenomenon of fine line dropouts seldom occurred when printing a fine-line image (a one-dot line, etc. in a 400-dpi image).

In this embodiment, however, since the end of the aluminum evaporated layer 29 was very close to the electrostatic latent image formed on the photoconductor 15, in a high temperature, high humidity environment (33° C., 80%) a phenomenon was occasionally observed in which the charges accumulated on the aluminum evaporated layer 29 flowed into the photoconductor, causing an image dropout in the vertical scanning direction. This phenomenon was alleviated by removing the aluminum evaporated layer 29 about 1 mm from the end. However, when the aluminum evaporated layer 29 was removed so far that there remained no aluminum evaporated layer in the area of the back surface of the sealing member 27 directly opposite the area of the front surface thereof contacting the photoconductor 15, fine line dropouts frequently occurred.

(Embodiment 2)

Figure 4:
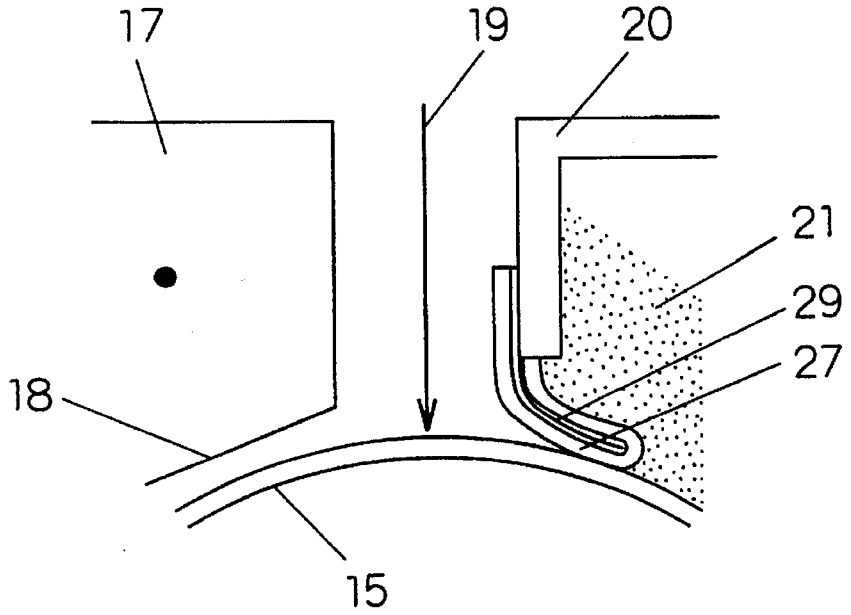
FIG. 4 is an enlarged view of a sealing member and its adjacent parts in the second embodiment of the present invention.

FIG. 4 is an enlarged view of a sealing member and its adjacent parts of an electrophotographic apparatus according to a second embodiment of the present invention. The overall construction of the apparatus is the same as that shown in FIG. 1, the only difference being in the construction of the sealing member. In FIG. 4, reference numeral 15 is a photoconductor, 17 is a corona charging unit, 18 is a grid electrode, 19 is a signal light, 20 is a developer reservoir, 21 is toner, and 27 is a 38 μm thick sealing member, formed from a polyethylene terephthalate film, for sealing the gap between the developer reservoir and the photoconductor. Further, reference numeral 29 is an aluminum layer evaporated on the opposite surface of the sealing member 27 from the surface thereof contacting the photoconductor 15. The sealing member 27 is fixed in position with its end folded away from the photoconductor 15, as shown in FIG. 4. The toner used in this embodiment and the operation of the apparatus are the same as those described in the first embodiment. According to the above construction, fine line dropouts seldom occurred. Furthermore, the phenomenon of image dropouts in the vertical scanning direction in a high temperature, high humidity environment (33° C., 80%) did not occur.

It will also be noted that the same effect was obtained when the end of the sealing member 27 was curled in such a manner as to enclose the aluminum layer therein.

(Embodiment 3)

Figure 5:
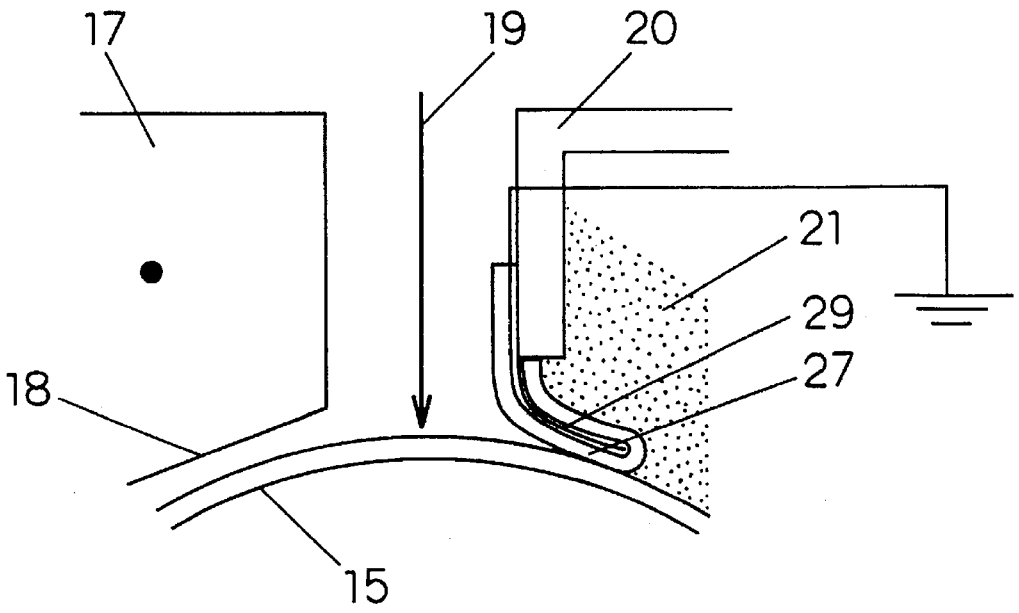
FIG. 5 is an enlarged view of a sealing member and its adjacent parts in the third embodiment of the present invention.

FIG. 5 is an enlarged view of a sealing member and its adjacent parts of an electrophotographic apparatus according to a third embodiment of the present invention. The overall construction of the apparatus is the same as that shown in FIG. 1, the only difference being in the construction of the sealing member. In FIG. 5, reference numeral 15 is a photoconductor, 17 is a corona charging unit, 18 is a grid electrode, 19 is a signal light, 20 is a developer reservoir, 21 is toner, and 27 is a 38 μm thick sealing member, formed from polyethylene terephthalate film, for sealing the gap between the developer reservoir and the photoconductor. Further, reference numeral 29 is an aluminum layer evaporated on the opposite surface of the sealing member 27 from the surface thereof contacting the photoconductor 15. The sealing member 27 is fixed in position with its end folded away from the photoconductor 15, as shown in FIG. 4. Further, the aluminum evaporated layer 29 is grounded. The toner used in this embodiment and the operation of the apparatus are the same as those described in the first embodiment. This construction provided a further stabilized effect against fine line dropouts than when the aluminum evaporated layer 29 was electrically floated.

(Embodiment 4)

Figure 6:
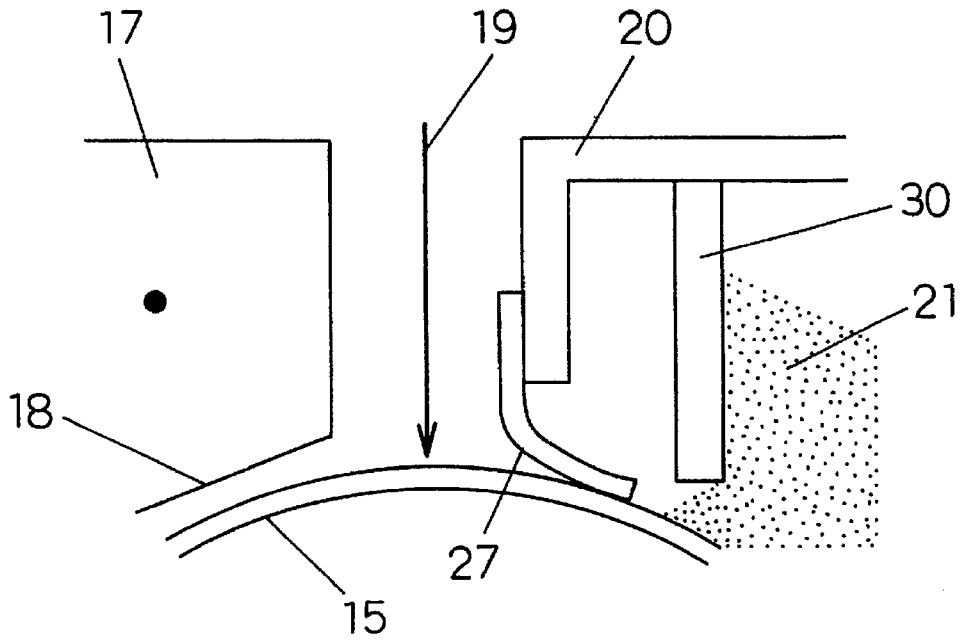
FIG. 6 is an enlarged view of a sealing member and its adjacent parts in the fourth embodiment of the present invention.

FIG. 6 is an enlarged view of a sealing member and its adjacent parts of an electrophotographic apparatus according to a fourth embodiment of the present invention. The overall construction of the apparatus is the same as that shown in FIG. 1, the only difference being in the construction of the sealing member. In FIG. 6, reference numeral 15 is a photoconductor, 17 is a corona charging unit, 18 is a grid electrode, 19 is a signal light, 20 is a developer reservoir, 21 is toner, and 27 is a 38 μm thick sealing member, formed from a polyethylene terephthalate film, for sealing the gap between the developer reservoir and the photoconductor. Further, reference numeral 30 is a second sealing member for blocking the flow of toner from the toner reservoir 20 so that the toner will not be carried to the sealing member 27. The toner used in this embodiment and the operation of the apparatus are the same as those described in the first embodiment. According to the above construction, fine line dropouts seldom occurred.

(Embodiment 5)

Figure 7:
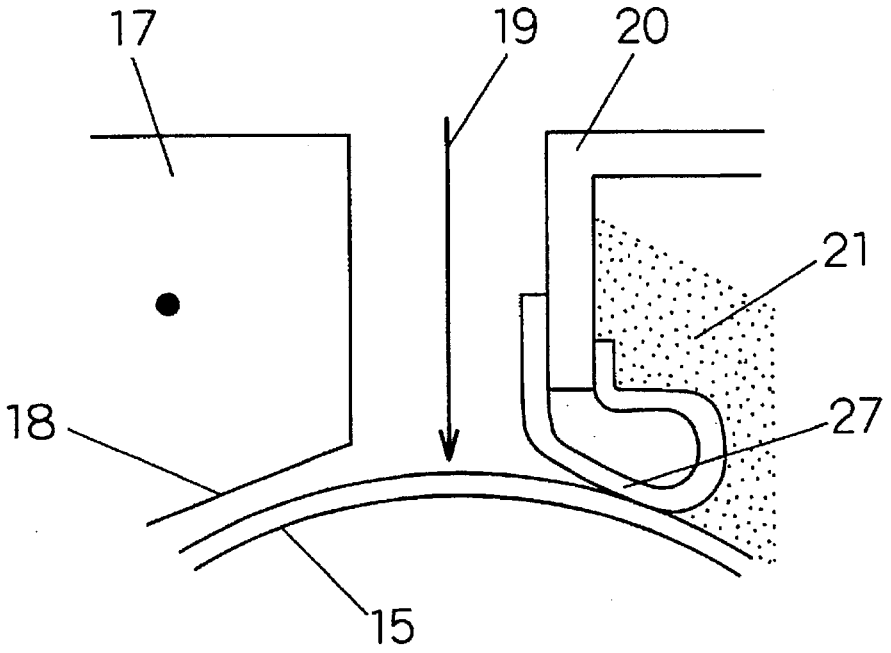
FIG. 7 is an enlarged view of a sealing member and its adjacent parts in the fifth embodiment of the present invention.

FIG. 7 is an enlarged view of a sealing member and its adjacent parts of an electrophotographic apparatus according to a fifth embodiment of the present invention. The overall construction of the apparatus is the same as that shown in FIG. 1, the only difference being in the construction of the sealing member. In FIG. 7, reference numeral 15 is a photoconductor, 17 is a corona charging unit, 18 is a grid electrode, 19 is a signal light, 20 is a developer reservoir, 21 is toner, and 27 is a 38 μm thick sealing member, formed from a polyethylene terephthalate film, for sealing the gap between the developer reservoir and the photoconductor. The sealing member 27 is formed in a large loop shape as shown. The toner used in this embodiment and the operation of the apparatus are the same as those described in the first embodiment. According to the above construction, fine line dropouts seldom occurred.

(Embodiment 6)

Figure 8:
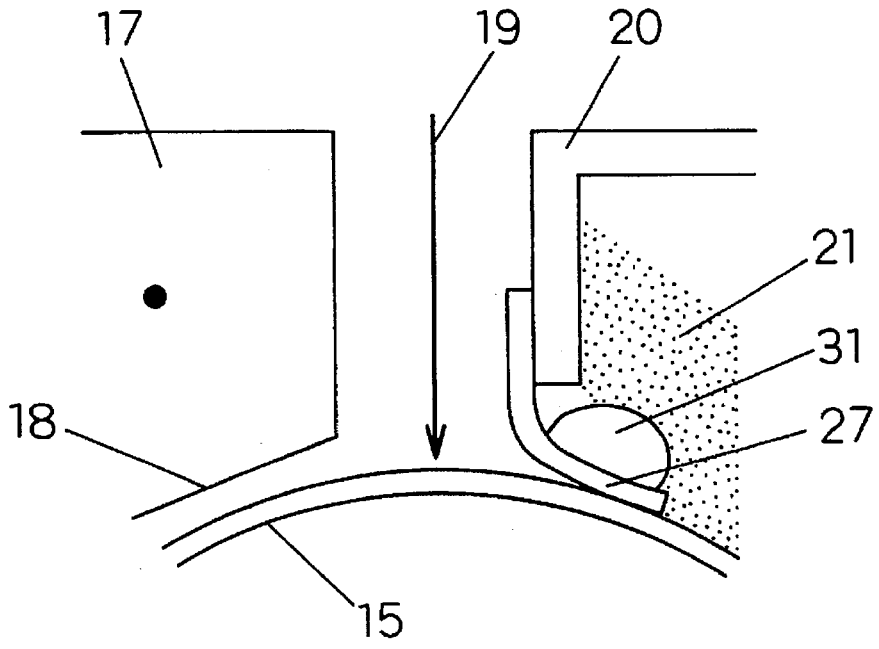
FIG. 8 is an enlarged view of a sealing member and its adjacent parts in the sixth embodiment of the present invention.

FIG. 8 is an enlarged view of a sealing member and its adjacent parts of an electrophotographic apparatus according to a sixth embodiment of the present invention. The overall construction of the apparatus is the same as that shown in FIG. 1, the only difference being in the construction of the sealing member. In FIG. 8, reference numeral 15 is a photoconductor, 17 is a corona charging unit, 18 is a grid electrode, 19 is a signal light, 20 is a developer reservoir, 21 is toner, and 27 is a 38 μm thick sealing member, formed from a polyethylene terephthalate film, for sealing the gap between the developer reservoir and the photoconductor. Further, reference numeral 31 is a rubber bonded to the opposite surface of the sealing member 27 from the surface thereof contacting the photoconductor 15. The toner used in this embodiment and the operation of the apparatus are the same as those described in the first embodiment. According to the above construction, fine line dropouts seldom occurred.

In this embodiment, rubber was used, but it will be noted that the same effect was obtained when other material such as resin or metal was used. When a magnetic material was used, a stable contact condition was obtained between the sealing member 27 and the photoconductor 15 and the sealing performance was improved because of the magnetic attraction between the magnetic material and the fixed magnet contained in the photoconductor. This also offered an effect against fine line dropouts.

(Embodiment 7)

Figure 9:
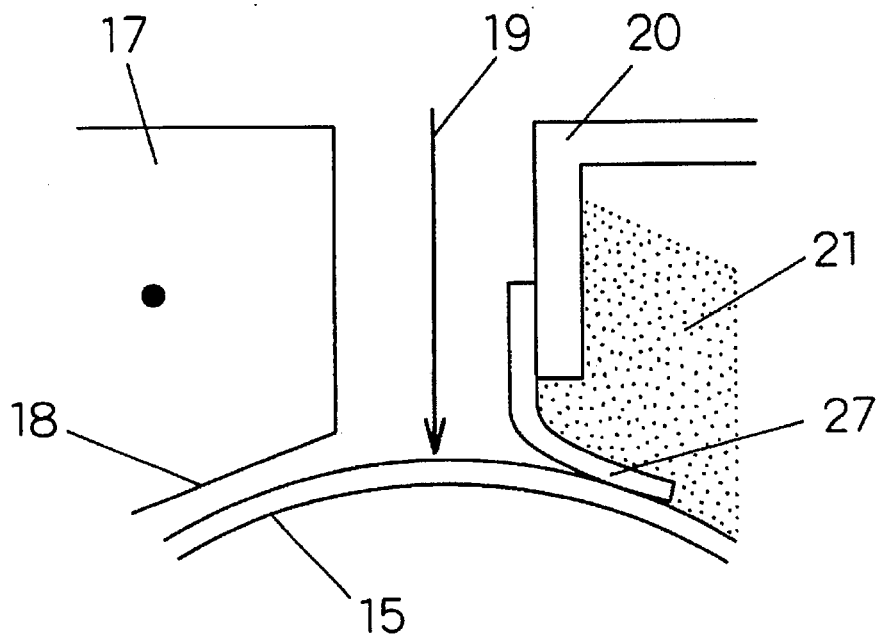
FIG. 9 is an enlarged view of a sealing member and its adjacent parts in the seventh embodiment of the present invention.

FIG. 9 is an enlarged view of a sealing member and its adjacent parts of an electrophotographic apparatus according to a seventh embodiment of the present invention. The overall construction of the apparatus is the same as that shown in FIG. 1, the only difference being in the construction of the sealing member. In FIG. 9, reference numeral 15 is a photoconductor, 17 is a corona charging unit, 18 is a grid electrode, 19 is a signal light, 20 is a developer reservoir, 21 is toner, and 27 is a 38 μm thick sealing member, formed from a carbon-kneaded polyethylene terephthalate film, for sealing the gap between the developer reservoir and the photoconductor. The toner used in this embodiment and the operation of the apparatus are the same as those described in the first embodiment. According to the above construction, fine line dropouts seldom occurred.

(Embodiment 8)

Figure 10:
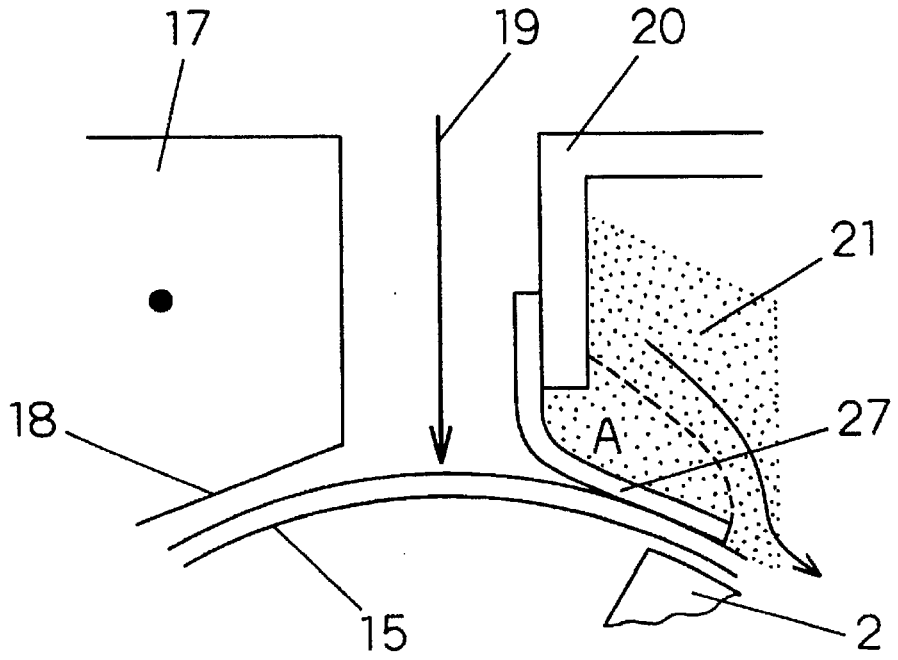
FIG. 10 is an enlarged view of a sealing member and its adjacent parts in the eighth embodiment of the present invention.
Figure 11:
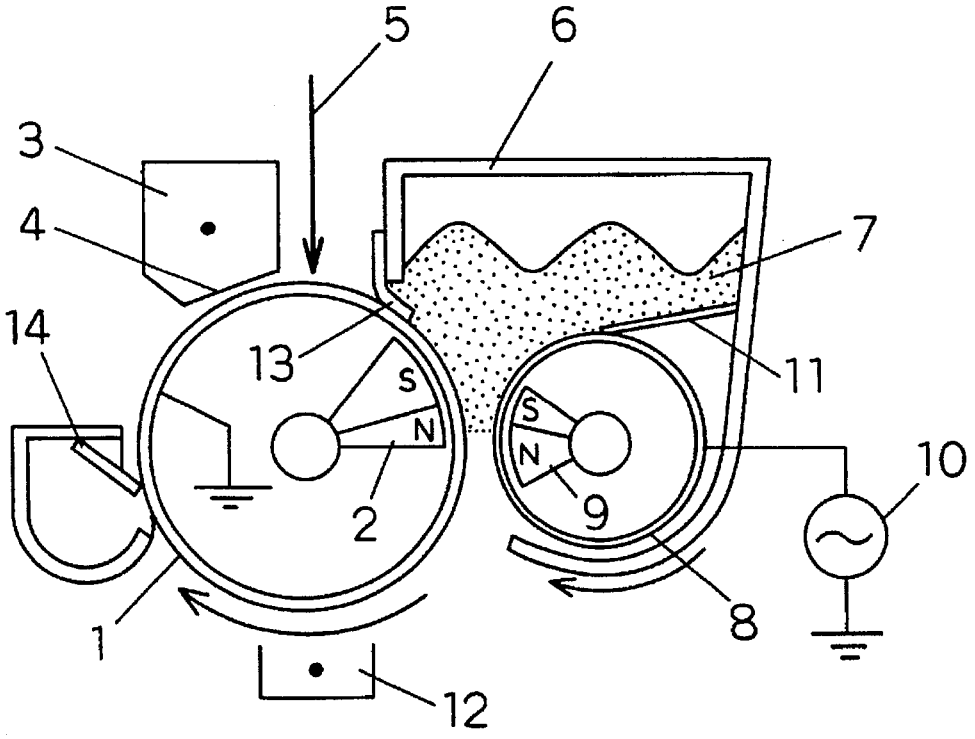
Fig. 11 PRIOR ART
FIG. 11 is a diagram showing the construction of an electrophotographic apparatus according to the prior art.

FIG. 10 is an enlarged view of a sealing member and its adjacent parts of an electrophotographic apparatus according to an eighth embodiment of the present invention. The overall construction of the apparatus is the same as that shown in FIG. 1, the only difference being in the construction of the sealing member. In FIG. 10, reference numeral 2 is a fixed magnet mounted inside the photoconductor drum, 15 is a photoconductor, 17 is a corona charging unit, 18 is a grid electrode, 19 is a signal light, 20 is a developer reservoir, 21 is toner, and 27 is a 38 μm thick sealing member, formed from a polyethylene terephthalate film for sealing the gap between the developer reservoir and the photoconductor, the sealing member having a free length of 7 mm with its end positioned opposite the fixed magnet mounted inside the photoconductor drum. The toner used in this embodiment and the operation of the apparatus are the same as those described in the first embodiment. According to the above construction, fine line dropouts seldom occurred.

When the toner flow in the vicinity of the sealing member 27 was observed, it was confirmed that the toner in area A enclosed with a dotted line in FIG. 10 remained stationary on the surface of the sealing member 27.

According to the present invention, an electrophotographic apparatus capable of producing a high quality image free from defects such as fine line dropouts can be obtained.

What is claimed is:

1. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, said sealing member having a front surface contacting said electrostatic latent image holding member and a back surface opposite said front surface, said back surface comprising a conductive layer formed thereon.

2. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller;

a sheet-like sealing member disposed, in contacting relationship with said electrostatic latent image holding member, on the upstream side of said developer reservoir in the rotating direction of said electrostatic latent image holding member; and a second sealing member, interposed between said sealing member and said developer reservoir, for preventing the developer supplied from said developer reservoir from being carried to the back surface of said sheet-like sealing member.

3. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like, loop-shaped sealing member disposed, in contacting relationship with said electrostatic latent image holding member, on the upstream side of said developer reservoir in the rotating direction of said electrostatic latent image holding member, wherein said loop-shaped sealing member has a space defined by said loop-shape on a back surface of said sealing member, said space being adapted to substantially prevent said magnetic developer from entering inside said space to inhibit discharging between said electrostatic latent image holding member and said sealing member.

4. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller;

a sheet-like sealing member disposed, in contacting relationship with said electrostatic latent image holding member, on the upstream side of said developer reservoir in the rotating direction of said electrostatic latent image holding member; and a spacer, bonded to the back surface of said sealing member, for filling a space on the side thereof opposite from where said sealing member contacts said electrostatic latent image holding member.

5. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, an end of said sealing member being positioned so that said end is subjected to the influence of a magnetic field generated by said magnetic field generating means mounted in said electrostatic latent image holding member, wherein said sealing member inhibits movement of said magnetic developer disposed near a back surface of said sealing member by using said magnetic field to fixedly hold said developer disposed near said back surface to said back surface.

6. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, said sealing member having a front surface contacting said electrostatic latent image holding member and a back surface opposite said front surface, said back surface comprising a conductive layer formed thereon to inhibit discharging between said electrostatic latent image holding member and said sealing member.

7. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, said sealing member having a surface resistance of $10^{12}$ Ω/□ or less to inhibit discharging between said electrostatic latent image holding member and said sealing member.

8. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, said sealing member having a conductive layer formed thereon which is grounded and having a surface resistance of $10^{12}$ Ω/□ or less.

9. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, said sealing member having a conductive layer formed thereon which is grounded and having a surface resistance of $10^{12}$ Ω/□ or less to inhibit discharging between said electrostatic latent image holding member and said sealing member.

10. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, said sealing member having a front surface contacting said electrostatic latent image holding member and a back surface opposite said front surface, said back surface comprising a conductive layer formed thereon wherein an end of said sealing member is folded back so as to enclose said conductive layer therein.

11. An electrophotographic apparatus according to claim 10, wherein said conductive layer formed on said sealing member is grounded.

12. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, said sealing member having a front surface contacting said electrostatic latent image holding member and a back surface opposite said front surface, said back surface comprising a conductive layer formed thereon wherein an end of said sealing member is curled so as to enclose said conductive layer therein.

13. An electrophotographic apparatus according to claim 12, wherein said conductive layer formed on said sealing member is grounded.

14. An electrophotographic apparatus comprising:

a magnetic developer;

an electrostatic latent image holding member rotating in a designated direction;

an electrode roller disposed opposite a surface of said electrostatic latent image holding member with a prescribed gap provided therebetween, and rotating in such a direction as to counter the rotation of said electrostatic latent image holding member;

a developer reservoir for supplying said magnetic developer to the surface of said electrostatic latent image holding member;

means for applying an AC voltage to said electrode roller to remove developer from nonimage areas of said electrostatic latent image holding member;

magnetic field generating means, mounted in a fixed position inside said electrostatic latent image holding member, for generating a magnetic pole at a surface position of said electrostatic latent image holding member near a developing area where said electrostatic latent image holding member faces said electrode roller; and a sheet-like sealing member disposed, in contacting relationship with said electrostatic latent image holding member, on the upstream side of said developer reservoir in the rotating direction of said electrostatic latent image holding member, said sealing member having a front surface contacting said electrostatic latent image holding member and a back surface opposite said front surface, said back surface comprising a conductive layer formed thereon wherein said conductive layer formed on said sealing member is grounded.

* * * * *